US006698498B1

(12) United States Patent
Ziegelaar et al.

(10) Patent No.: US 6,698,498 B1
(45) Date of Patent: Mar. 2, 2004

(54) CASTING STRIP

(75) Inventors: John Albert Ziegelaar, Farmborough Heights (AU); Heiji Kato, Yokosuka (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 09/958,187

(22) PCT Filed: Apr. 7, 2000

(86) PCT No.: PCT/AU00/00293

§ 371 (c)(1),
(2), (4) Date: Oct. 24, 2001

(87) PCT Pub. No.: WO00/61320

PCT Pub. Date: Oct. 19, 2000

(30) Foreign Application Priority Data

Apr. 8, 1999 (AU) ..... PP9644

(51) Int. Cl.[7] ..... B22D 11/06; B22D 11/126; B22D 11/20

(52) U.S. Cl. ..... 164/477; 164/480; 164/428; 164/460; 164/452; 164/413

(58) Field of Search ..... 164/480, 428, 164/460, 417, 477, 476, 451, 452, 454, 150.1, 413; 29/527.7

(56) References Cited

U.S. PATENT DOCUMENTS 3,612,148 A * 10/1971 Waldschmidt ..... 164/460
4,766,947 A * 8/1988 Shibuya et al. ..... 164/460
5,601,137 A * 2/1997 Abe et al. ..... 164/418
5,634,257 A * 6/1997 Kajiwara et al. ..... 29/527.7
6,039,283 A * 3/2000 Munoz-Baca et al. ..... 242/534

FOREIGN PATENT DOCUMENTS

| | | | |
|---|---|---|---|
| AU | A-60621/98 | | 6/1998 |
| EP | 0 181 090 | A1 | 5/1986 |
| EP | 0 286 082 | A2 | 10/1988 |
| JP | 55075861 | A * | 6/1980 |
| JP | 11342458 | A | 12/1999 |
| WO | WO 96/01708 | A1 | 1/1996 |
| WO | WO 98/57767 | A1 | 12/1998 |

* cited by examiner

*Primary Examiner*—M. Alexandra Elve
*Assistant Examiner*—Kevin McHenry
(74) *Attorney, Agent, or Firm*—Barnes & Thornburg

(57) ABSTRACT

Twin roll caster produces cast steel strip that passes in a transit path through pinch roll stand and optional hot rolling mill and runout table to a coiling station which has a pair of switchable coilers. A strip shear located in advance of the coiling station is operable to sever strip into discrete lengths which can be diverted by setting deflectors to allow the severed lengths to pass across a runout table to a scrap bin. The strip may be thus severed and diverted to scrap on development of strip defects or malfunctioning of equipment without stopping continuous casting and the strip redirected to the coiling station when the problem is rectified.

29 Claims, 3 Drawing Sheets

CASTING STRIP

CROSS-REFERENCE TO RELATED APPLICATIONS

This application is a U.S. national counterpart application of international application serial No. PCT/AU00/00293 filed Apr. 7, 2000, which claims priority to Australian provisional application serial No. PP 9644 filed Apr. 8, 1999.

BACKGROUND AND SUMMARY OF THE INVENTION

This invention relates to the casting of metal strip. It has particular but not exclusive application to the casting of ferrous metal strip.

It is known to cast metal strip by continuous casting of strip in a twin roll caster.

Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or a series of smaller vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals which have high solidification temperatures and a tendency to produce defects caused by uneven solidification at the chilled casting surfaces of the rolls.

Strip defects such as, for example, severe transverse cracks may cause the strip to tear and shear and may, during continuous casting, cause a complete shutdown of operations if adequate provision is not made for effective handling of defective strip on line. Malfunctioning of the casting or strip handling equipment can also require a complete shutdown of the casting line.

Shut downs of continuous strip casting operations are expensive in terms of loss of productivity, in terms of the potential for damage of equipment and in terms of the increase in risk to the health and safety of personnel and other hazards that occur as a result of strip breakout.

The present invention enables shut downs to be minimised, even when defective strip develops or there is an equipment failure, by allowing diversion of the defective strip to scrap and subsequent take up of strip for end use when the cause of the defects or equipment malfunction has been rectified, without shutting down the continuous strip casting operation.

According to the invention there is provided a method of continuously casting and handling metal strip, comprising:

supporting a casting pool of molten metal on one or more chilled casting surfaces;

moving the chilled casting surface or surfaces to produce a solidified strip moving away from the casting pool;

guiding the solidified strip along a transit path which takes it away from the casting pool to a coiling station;

coiling the strip onto a coiler at the coiling station;

operating a strip shearing means so as to sever the strip in advance of the coiling station into discrete lengths;

diverting the severed lengths of strip from the coiling station to a scrap station; and halting the operation of the strip shearing means so as to reinstate delivery of continuous strip to the coiling station and directing the reinstated continuous strip to a second coiler at the coiling station.

Preferably, a scrap bin is located at the scrap station to receive the severed lengths of strip.

The operation of the strip shearing means and diversion of the severed lengths of strip to the scrap station may be activated in response to observation or detection of defects in the strip or malfunctioning of equipment employed in the casting or handling of the strip. In this context the term "defects" may extend to any properties or attributes of the strip which may be undesirable for an end user or for further processing. Such defects may be observed or detected by visual observation by an operator and/or by detection instrumentation.

Specifically, the method may include the steps of inspecting the strip for defects as it passes in said transit path by means of strip defect detection means located along that path and initiating operation of the strip shearing means in response to an indication from the defect detection means of defects in the strip.

The defect detection means may be operated to detect variations in thickness of the strip and/or surface defects in the strip.

The defect detection means may comprise an X-ray gauge and a surface defect detector.

The casting pool of molten metal may be maintained by flow of molten metal from a tundish supplied alternatively by each of a plurality of ladles brought to a pouring position by a rotating turret.

The invention further provides apparatus for continuously casting and handling metal strip comprising:

a pair of generally horizontal casting rolls forming a nip between them;

metal delivery means to deliver molten metal into the nip between the casting rolls to form a casting pool of molten metal supported on the rolls;

means to chill the casting rolls;

means to rotate the casting rolls in mutually opposite directions whereby to produce a cast strip delivered downwardly from the nip;

strip guide means to guide the strip delivered downwardly from the nip through a transit path which takes it away from the nip;

a coiling station to receive strip from said transit path and provided with a pair of coilers and strip deflector means operable alternatively to direct the strip to one or other of the coilers;

strip shearing means operable repeatedly to sever the strip in advance of the coiling station to chop the continuously delivered strip into a multiplicity of discrete strip lengths; and strip diverter means to divert the multiplicity of discrete strip lengths so as to bypass both coilers at the coiling station and deliver them to a scrap station.

The apparatus may further include strip defect detection means disposed along said transit path in advance of the coiling station and operable to detect defects in the strip and the shearing means may be operable in response to an indication from the defect detection means of defects in the strip.

BRIEF DESCRIPTION OF THE DRAWINGS

In order that the invention may be more fully explained one particular embodiment will be described in detail with reference to the accompanying drawings in which.

DETAILED DESCRIPTION OF THE DRAWINGS

Figure 1:
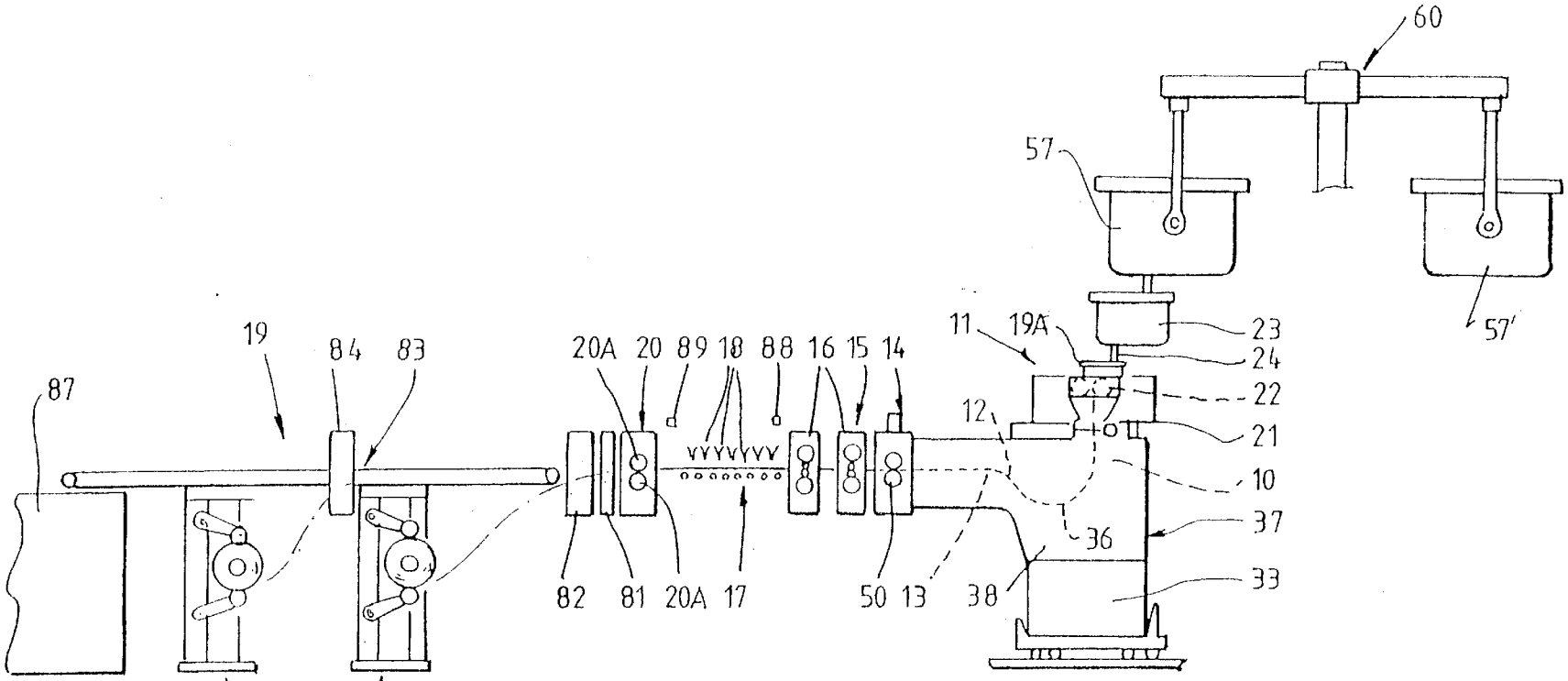
FIG. 1 illustrates strip casting and rolling installation constructed and operated in accordance with the present invention.
Figure 2:
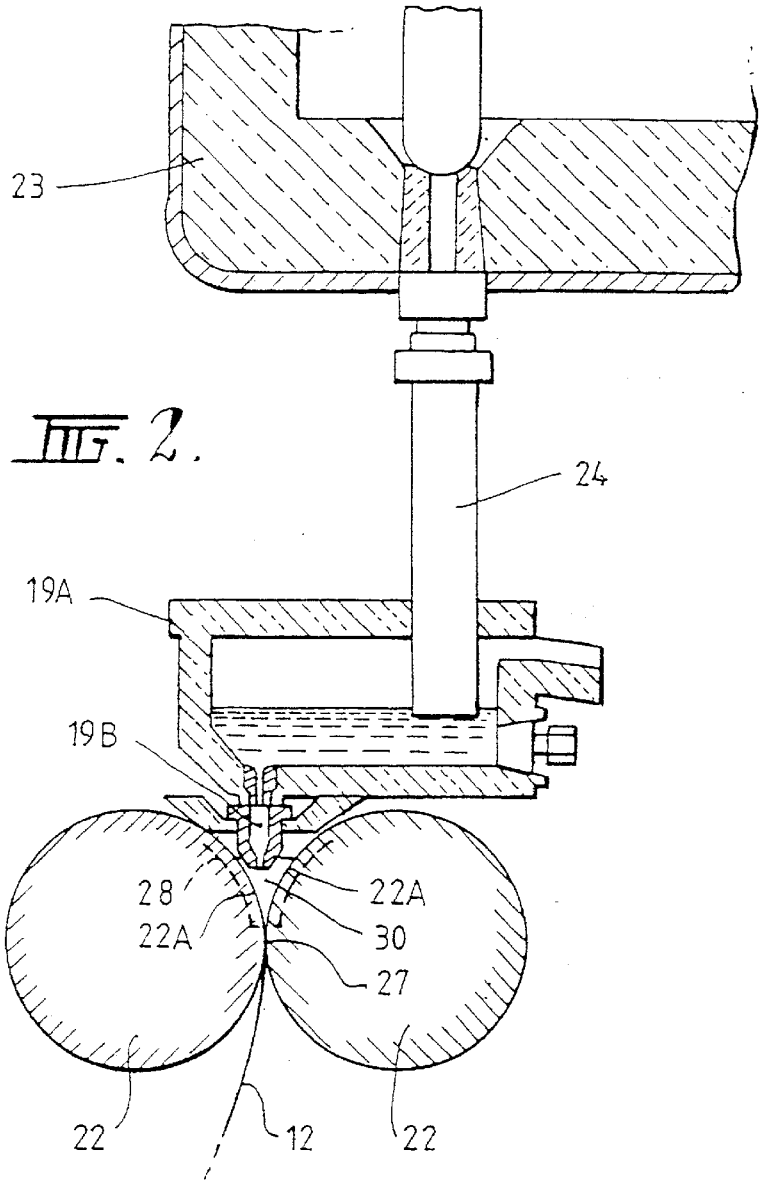
FIG. 2 illustrates further detail of the strip caster.
Figure 3:
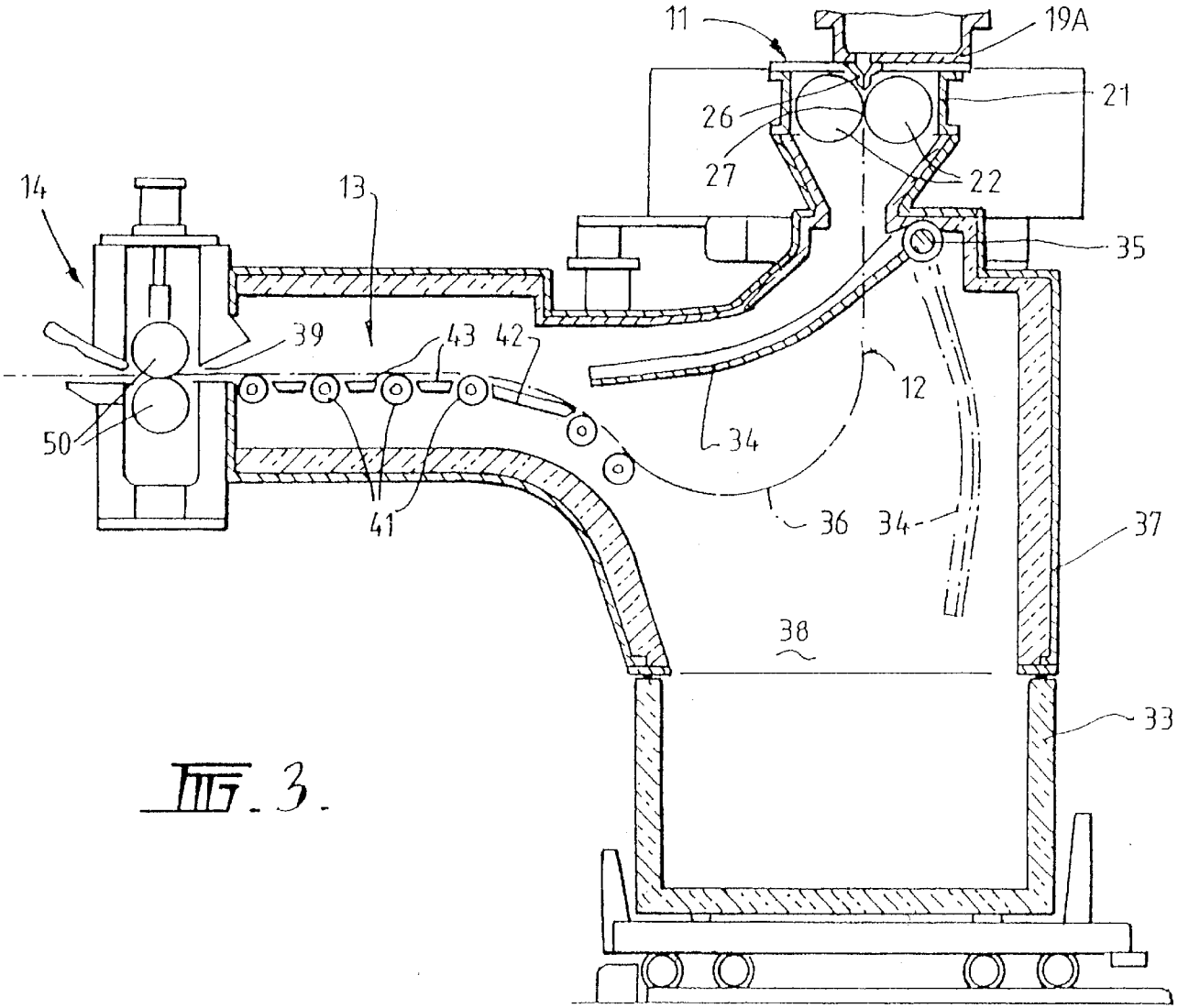
FIG. 3 illustrates that part of the installation which receives and transports the strip issuing from the caster.

The casting and rolling installation illustrated in FIGS. 1 to 3 comprises a twin roll caster denoted generally as 11 which produces a cast steel strip 12 that passes in a transit path 10 across a guide table 13 to a pinch roll stand 14. Immediately after exiting the pinch roll stand 14, the strip passes into an optional hot rolling mill 15 comprising roll stands 16 in which it may be hot rolled to reduce its thickness. The strip, whether rolled or not, then passes onto a runout table 17 on which it may be force cooled at a cooling station by water jets 18, then through a pinch roll stand 20 comprising a pair of pinch rolls 20A and thence to a coiling station 19 which includes a pair of switchable coilers 85, 86.

Twin roll caster 11 comprises a main machine frame 21 which supports a pair of parallel casting rolls 22 having casting surfaces 22A. Molten metal is supplied during a casting operation from a ladle 57 to a tundish 23 through a refractory shroud 24 to a distributor 19A and thence through a metal delivery nozzle 19B into the nip 27 between the casting rolls 22. Molten metal thus delivered to the nip 27 forms a pool 30 above the nip and this pool is confined at the ends of the rolls by a pair of side closure dams or plates 28 which are applied to stepped ends of the rolls by a pair of thrusters (not shown) comprising hydraulic cylinder units connected to side plate holders. The upper surface of pool 30 (generally referred to as the meniscus level) may rise above the lower end of the delivery nozzle so that the lower end of the delivery nozzle is immersed within this pool.

Casting rolls 22 are water cooled so that shells solidify on the moving roller surfaces and are brought together at the nip 27 between them to produce the solidified strip 12 which is delivered downwardly from the nip between the rolls.

Ladle 57 is supported on a rotating turret 60 by which ladle 57 is brought into position above the tundish 23 to deliver molten metal thereto. Once the molten metal in ladle 57 has been downloaded, the rotating turret moves the near empty ladle 57 to a standby station remote from the downloading station and at the same time brings a laden substitute ladle 57' from a standby location into position above the tundish 23 for downloading thereby providing a substantially continuous supply of molten metal to the tundish. The near empty ladle 57 is refilled at a remote location and returned to the standby location.

At the start of a casting operation a short length of imperfect strip is produced as the casting conditions stabilise. After continuous casting is established, the casting rolls are moved apart slightly and then brought together again to cause this leading end of the strip to break away in the manner described in Australian Patent 646981 and U.S. Pat. No. 5,287,912 so as to form a clean head end of the following cast strip. The imperfect material drops into a scrap box 33 located beneath caster 11 and at this time a swinging apron 34 which normally hangs downwardly from a pivot 35 to one side of the caster outlet is swung across the caster outlet to guide the clean end of the cast strip onto the guide table 13 which feeds it to the pinch roll stand 14. Apron 34 is then retracted back to its hanging position to allow the strip 12 to hang in a loop beneath the caster before it passes to the guide table 13 where it engages a succession of guide rolls 41. The guide table comprises a series of strip support rolls 41 to support the strip before it passes to the pinch roll stand 14 and a series of table segments 42, 43 disposed between the support rolls. The rolls 41 are disposed in an array which extends back from the pinch roll stand 14 toward the caster so as to receive and guide the strip from the loop 36.

The twin roll caster may be of the kind as thus far described or may be of the kind which is illustrated and described in some detail in granted Australian Patents 631728 and 637548 and U.S. Pat. Nos. 5,184,668, 5,277,243 or U.S. Pat. No. 5,488,988 and reference may be made to those patents for appropriate constructional details.

In order to control the formation of scale on the hot strip, an installation is manufactured and assembled to form a single very large scale enclosure denoted generally as 37 defining a sealed space 38 within which the steel strip 12 is confined throughout a transit path from the nip between the casting rolls to the entry nip 39 of the pinch roll stand 14.

Enclosure 37 is formed by a number of separate wall sections which fit together at various seal connections to form a continuous enclosure wall.

The function and construction of enclosure 37 is fully described in Australian Patent 704312.

Pinch roll stand 14 comprises a pair of pinch rolls 50 which resist the tension applied by the reduction roll stands 16. Accordingly, the strip is able to hang in the loop 36 as it passes from the casting rolls 22 to the guide table 13 and into the pinch roll stand 14. The pinch rolls 50 thus provide a tension barrier between the freely hanging loop and the tensioned downstream part of the processing line. They are also intended to stabilise the position of the strip on the feed table and feed it in to the rolling mill 16.

Accordingly, the strip exits the enclosure 38 by passing between the pair of pinch rolls 50 and it passes into the hot rolling mill 15.

After leaving the rolling mill 15, the strip passes to run table 17 and through pinch roll stand 20 to the coiling station 19 at which it can be wound alternatively onto two coilers 85 and 86 which are selectively switched for winding up the strip. Additional switchable coilers may be provided.

To enable operation in accordance with the present invention, there is provided downstream from pinch roll 20 a shear 81, a deflectors 82, 84 a runout table 83 and a scrap bin 87. A strip defect detector in the form of a conventional X-ray gauge 88 is located above the runout table 17 in advance the cooling water sprays 18 and a strip surface defect detection device 89 is located above table 17 downstream from the sprays 18. X-ray gauge 88 may be operated to monitor thickness variations in the strip. The surface defect detection device may be an optical scanner or an array of sensors to receive visual or other forms of radiation from the strip surface.

In normal production, deflectors 82, 84 are selectively operable to deflect the strip to the selected coiler 85 or 86 and to enable the strip to be redirected to change coilers when one coiler has been filled, so allowing effectively continuous casting and coiling.

If either of the strip defect detectors detects a deterioration of strip quality to the extent that it is suitable only for scrap, then shear 81 may be operated to cut the defective strip into discrete lengths and deflectors 82, 84 are operated so that the cut lengths of strip pass along a runout table 83 to a scrap bin 87 at the end of the line, thus bypassing both coilers at the coiling station.

The scrapping of defective strip is continued until the quality of the strip improves or the casting process is stopped. Downstream scrapping of strip in this manner facilitates smooth continuous operation of the caster. It eliminates the need to stop casting by either dumping the molten metal or casting strip into the scrap box below the casting rolls. Although this box is capable of handling a quantity of molten steel and scrap strip, it is limited in size.

Downstream scrapping of strip also eliminates the coiling of material, which is not suitable for the intended use. Coiling all material into discrete coils, regardless of the quality, would require additional processing to separate the unsuitable product from the suitable product and may result in more product lost due to restrictions on minimum acceptable coil weights.

Downstream scrapping of the strip may also be used to maintain continuous casting operations in the event of the coiling station becoming completely or partly unavailable. This may be due to a complete or partial equipment failure of the deflectors, the coiling station or downstream equipment. In this case the casting operation could continue while the equipment fault is rectified.

If the cause of the strip defects can be overcome to rectify the strip quality or the coiling station becomes available as casting continues, the shear 81 is deactivated and the appropriate deflector 82 or 84 is operated to redirect the strip to the standby coiler 85 or 86. The method of the invention thus permits scrapping of defective strip in the middle of a production run and redirection of the strip onto a new coiler when the defects have been rectified, without interrupting continuous casting. Continuous casting may therefore proceed over long production shifts with delivery of molten metal being maintained through the rotating ladle turret system.

Figure 4:
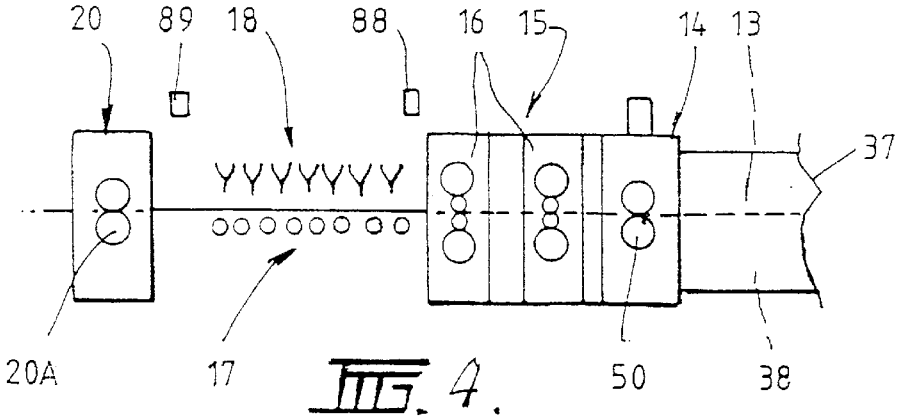
FIG. 4 illustrates part of a modified strip casting and rolling installation constructed and operated in accordance with the invention.

FIG. 4 illustrates a modification by which the enclosure 37 is extended to enclose the rolling mill 15 so that the strip is rolled before it leaves the enclosure space 38. In this case, the strip exits the enclosure through the last of the mill stands 16 the rolls of which serve also to seal the enclosure so that the separate sealing pinch rolls are not required.

It is worth noting that while there are similarities between a conventional hot strip mill operation and a strip caster, there are major differences between the two.

A conventional hot strip mill is a semi continuous or piece process with individual slabs being rolled to create individual or multiple coils. The hot strip mill process can easily be stopped to rectify a defect cause and restarted once the cause has been eliminated, with some individual loss of product. A strip caster is a completely continuous process, which cannot be easily stopped and restarted, and therefore requires a means to remove a defective portion of the continuous strip without interfering with the operation of the process.

A conventional hot strip mill also has a number of discrete process steps spread along a considerable length of line. Individual pieces of defective product may be removed after an intermediate step. The strip caster is a very short line with no limited possibilities to remove product after an intermediate step without severely disrupting the process.

The illustrated methods and forms of apparatus have been described by way of example only and may be modified considerably. For example, the invention is not limited in its application to processes in which the cast strip is hot rolled in line with the caster and it could be applied to strip which is simply reduced in temperature and coiled after casting. The strip may, for example, pass over a runout table after casting on which it is force cooled to a coiling temperature of the order of 660° C.

The illustrated apparatus has been advanced by way of example only and it could be modified considerably. The method of the invention enables continuous strip casting in the face of either strip quality failure or equipment failure. Equipment failure can occur anywhere along the line and may for example include coiler failure or deflector failure.

The strip defect detector can be located at other sites along the line for example, below the nip. Some defects such as meniscus marks and herringbone are most observable when the strip is red hot. The scrapping station can be located anywhere after the shear, it need not be located at the end of the line. Indeed, the strip can be diverted anywhere other than to the coilers. It is accordingly to be understood that the invention is in no way limited to the detail of the illustrated apparatus and that many variations will fall within the scope of the appended claims.

What is claimed is:

1. A method of continuously casting and handling metal strip, comprising:

supporting a casting pool of molten metal on one or more chilled casting surfaces;

moving the casting surface or surfaces to produce a solidified strip moving away from the casting pool;

guiding the solidified strip along a transit path which takes it away from the casting pool to a coiling station;

coiling the strip onto a coiler at the coiling station;

operating a strip shearing so as to sever the strip in advance of the coiling station into discrete lengths;

diverting the severed lengths of strip from the coiling station to a scrap station; and halting the operation of the strip shearing so as to reinstate delivery of continuous strip to the coiling station and directing the reinstated continuous strip to a second coiler at the coiling station.

2. A method as claimed in claim 1, wherein a scrap bin is located at the scrap station to receive the severed lengths of strip.

3. A method as claimed in claim 2, wherein the operation of the strip shearer and diversion of the severed lengths of strip to the scrap station is initiated in response to observation or detection of defects in the strip.

4. A method as claimed in claim 3, comprising the steps of inspecting the strip for defects as it passes in said transit path by means of strip defect detector located along that path and initiating operation of the strip shearer in response to an indication from the defect detector of defects in the strip.

5. A method as claimed in claim 4, wherein the defect detector is operated to detect variations in thickness of the strip.

6. A method as claimed in claim 5, wherein the defect detector comprises an X-ray gauge.

7. A method as claimed in claim 4, wherein the defect detector is operated to detect surface defects in the strip.

8. A method as claimed in claim 4, wherein the strip proceeding along said transit path passes through a cooling station and the strip is examined by the defect detector upstream and downstream of the cooling station.

9. A method as claimed in claim 8, wherein the strip is examined upstream of the cooling station for thickness defects and is examined downstream of the cooling station for surface defects.

10. A method as claimed in claim 2, wherein the operation of the strip shearer and diversion of the severed lengths of strip to the scrap station is initiated in response to malfunctioning of equipment employed in the casting or handling of the strip.

11. A method as claimed in claim 1, wherein the operation of the strip shearer and diversion of the severed lengths of strip to the scrap station is initiated in response to observation or detection of defects in the strip.

12. A method as claimed in claim 11, comprising the steps of inspecting the strip for defects as it passes in said transit path by means of a strip defect detector located along that path and initiating operation of the strip shearer in response to an indication from the defect detector of defects in the strip.

13. A method as claimed in claim 12, wherein the defect detector is operated to detect variations in thickness of the strip.

14. A method as claimed in claim 13, wherein the defect detector comprises an X-ray gauge.

15. A method as claimed in claim 12, wherein the defect detector is operated to detect surface defects in the strip.

16. A method as claimed in claim 12, wherein the strip proceeding along said transit path passes through a cooling station and the strip is examined by the defect detector upstream and downstream of the cooling station.

17. A method as claimed in claim 16, wherein the strip is examined upstream of the cooling station for thickness defects and is examined downstream of the cooling station for surface defects.

18. A method as claimed in claim 1, wherein the operation of the strip shearer and diversion of the severed lengths of strip to the scrap station is initiated in response to malfunctioning of equipment employed in the casting or handling of the strip.

19. A method as claimed in claim 1, wherein the casting pool of molten metal is maintained by flow of molten metal from a tundish supplied alternatively by each of a plurality of ladles brought to a pouring position by a rotating turret.

20. An apparatus for continuously casting and handling metal strip comprising:

a pair of generally horizontal chilled casting rolls forming a nip between them;

a metal delivery system to deliver molten metal into the nip between the casting rolls to form a casting pool of molten metal supported on the rolls;

a rotator to rotate the casting rolls in mutually opposite directions whereby to produce a cast strip delivered downwardly from the nip;

a strip guide to guide the strip delivered downwardly from the nip through a transit path which takes it away from the nip;

a coiling station to receive the strip from said transit path and provided with a pair of coilers and a strip deflector apparatus operable alternatively to direct the strip to one or other of the coilers;

a strip shearer downstream of the strip guide operable repeatedly to sever the strip in advance of the coiling station to chop the continuously delivered strip into a multiplicity of discrete strip lengths; and a strip diverter to divert the multiplicity of discrete strip lengths so as to bypass both coilers at the coiling station and deliver them to a scrap station.

21. An apparatus as claimed in claim 20, wherein a scrap bin is located at the scrap station to receive the severed lengths of strip.

22. An apparatus as claimed in claim 21, wherein there is a pair of strip deflectors at the coiling station operable alternatively to divert the strip to one or other of the coilers.

23. An apparatus as claimed in claim 20, wherein the strip deflector apparatus comprises a pair of strip deflectors at the coiling station operable alternatively to divert the strip to one or other of the coilers.

24. An apparatus as claimed in claim 23, wherein the strip diverter comprises a runout table to guide the severed strip lengths to the scrap station when the deflectors are inoperative to deflect strip to either coiler.

25. An apparatus as claimed in claim 20, and further including a strip defect detector disposed along said transit path in advance of the coiling station and operable to detect defects in the strip.

26. An apparatus as claimed in claim 25, wherein there is an operative connection between the defect detector and the shearer such that the shearer is operable in response to an indication from the defect detector of defects in the strip.

27. An apparatus as claimed in claim 25, wherein the defect detector is operable to detect variations in thickness of the strip.

28. An apparatus as claimed in claim 27, wherein the defect detector comprises an X-ray gauge.

29. An apparatus as claimed in claim 25, wherein the defect detector is operable to detect surface defects in the strip.

* * * * *